US006708769B2

(12) United States Patent
Haugen et al.

(10) Patent No.: US 6,708,769 B2
(45) Date of Patent: Mar. 23, 2004

(54) APPARATUS AND METHODS FOR FORMING A LATERAL WELLBORE

(75) Inventors: David M. Haugen, League City, TX (US); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/848,900

(22) Filed: May 4, 2001

(65) Prior Publication Data

US 2001/0040054 A1 Nov. 15, 2001

Related U.S. Application Data

(60) Provisional application No. 60/202,335, filed on May 5, 2000.

(51) Int. Cl.[7] ..... E21B 19/16; E21B 29/08; E21B 29/10

(52) U.S. Cl. ..... 166/384; 166/55.1; 166/212; 166/297

(58) Field of Search ..... 166/277, 297, 166/298, 313, 382, 50, 55, 55.1, 55.6, 66.4, 117.5, 117.6, 117.7, 206, 207, 212, 381

(56) References Cited

U.S. PATENT DOCUMENTS

| | | | | |
|---|---|---|---|---|
| 761,518 | A | 5/1904 | Lykken | |
| 988,504 | A | 3/1911 | Wiet | |
| 1,301,285 | A | 4/1919 | Leonard | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,880,218 | A | 10/1932 | Simmons | |
| 1,930,825 | A | 10/1933 | Raymond | |
| 1,981,525 | A | 11/1934 | Price | 166/4 |
| 2,017,451 | A | 10/1935 | Wickersham | 166/10 |
| 2,214,226 | A | 9/1940 | English | 166/1 |
| 2,216,226 | A | 10/1940 | Bumpous | 36/44 |
| 2,383,214 | A | 8/1945 | Prout et al. | 153/82 |
| 2,424,878 | A | 7/1947 | Crook | 154/82 |
| 2,499,630 | A | 3/1950 | Clark | 153/81 |
| 2,519,116 | A | 8/1950 | Crake | 166/10 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,797,893 | A * | 7/1957 | McCune et al. | 166/117.5 |

(List continued on next page.)

FOREIGN PATENT DOCUMENTS

| | | | |
|---|---|---|---|
| DE | 3 213 464 | 10/1983 | B23D/45/12 |
| DE | 4 133 802 | 10/1992 | F16L/9/12 |
| EP | 0 961 007 | 12/1999 | E21B/33/10 |

(List continued on next page.)

OTHER PUBLICATIONS

Hahn, et al., Provisional Application No. 60/170,108, Filed Dec. 10, 1999 Entitled: Apparatus and Method for Simultaneous Drilling and Casing Wellbores.

(List continued on next page.)

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

A method and system of forming a lateral wellbore in a time and trip saving manner using a mill/drill to locate and place a casing window. In one aspect of the invention, a lateral wellbore is drilled with liner which is subsequently left in the lateral wellbore to line the sides thereof. In another aspect, the mill/drill is rotated with a rotary steerable system and in another aspect, the mill/drill is rotated with a downhole motor or a drill stem.

31 Claims, 7 Drawing Sheets

U.S. PATENT DOCUMENTS

| | | | | | |
|---|---|---|---|---|---|
| 2,898,971 | A | | 8/1959 | Hempel | 153/82 |
| 3,028,915 | A | | 4/1962 | Jennings | 166/16 |
| 3,039,530 | A | | 6/1962 | Condra | 166/55 |
| 3,087,546 | A | | 4/1963 | Wooley | 166/46 |
| 3,167,122 | A | | 1/1965 | Lang | 166/14 |
| 3,179,168 | A | | 4/1965 | Vincent | 166/14 |
| 3,186,485 | A | | 6/1965 | Owen | 166/63 |
| 3,191,677 | A | | 6/1965 | Kinley | 166/14 |
| 3,191,680 | A | | 6/1965 | Vincent | 166/46 |
| 3,195,646 | A | | 7/1965 | Brown | 166/208 |
| 3,203,451 | A | | 8/1965 | Vincent | 138/143 |
| 3,203,483 | A | | 8/1965 | Vincent | 166/207 |
| 3,245,471 | A | | 4/1966 | Howard | 166/46 |
| 3,297,092 | A | | 1/1967 | Jennings | 166/207 |
| 3,326,293 | A | | 6/1967 | Skipper | 166/150 |
| 3,353,599 | A | | 11/1967 | Swift | 166/15 |
| 3,354,955 | A | | 11/1967 | Berry | 166/14 |
| 3,467,180 | A | | 9/1969 | Pensotti | 165/180 |
| 3,477,506 | A | | 11/1969 | Malone | 166/207 |
| 3,489,220 | A | | 1/1970 | Kinley | 166/277 |
| 3,552,510 | A | | 1/1971 | Brown | 175/261 |
| 3,583,200 | A | | 6/1971 | Cvijanovic et al. | 72/393 |
| 3,669,190 | A | | 6/1972 | Sizer et al. | 166/315 |
| 3,689,113 | A | | 9/1972 | Blaschke | 285/90 |
| 3,691,624 | A | | 9/1972 | Kinley | 29/523 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,785,193 | A | | 1/1974 | Kinley et al. | 72/393 |
| 3,818,734 | A | | 6/1974 | Bateman | 72/75 |
| 3,820,370 | A | | 6/1974 | Duffy | 72/75 |
| 3,911,707 | A | | 10/1975 | Minakov et al. | 72/76 |
| 3,948,321 | A | | 4/1976 | Owen et al. | 166/277 |
| 3,977,076 | A | | 8/1976 | Vieira et al. | 30/103 |
| 4,069,573 | A | | 1/1978 | Rogers, Jr. et al. | 29/421 R |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,319,393 | A | | 3/1982 | Pogonowski | 29/434 |
| 4,324,407 | A | | 4/1982 | Upham et al. | 277/27 |
| 4,349,050 | A | | 9/1982 | Bergstrom et al. | 138/147 |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,429,620 | A | | 2/1984 | Burkhardt et al. | 91/395 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 B |
| 4,502,308 | A | | 3/1985 | Kelly | 72/58 |
| 4,505,142 | A | | 3/1985 | Kelly | 72/54 |
| 4,505,612 | A | | 3/1985 | Shelley, Jr. | 405/101 |
| 4,531,581 | A | | 7/1985 | Pringle et al. | 166/120 |
| 4,567,631 | A | | 2/1986 | Kelly | 29/157.3 |
| 4,581,617 | A | | 4/1986 | Yoshimoto et al. | 346/108 |
| 4,588,030 | A | | 5/1986 | Blizzard | 166/120 |
| 4,626,129 | A | | 12/1986 | Kothmann et al. | 405/43 |
| 4,697,640 | A | | 10/1987 | Szarka | 166/120 |
| 4,699,224 | A | * | 10/1987 | Burton | 175/325.4 |
| 4,807,704 | A | | 2/1989 | Hsu et al. | 166/313 |
| 4,848,469 | A | | 7/1989 | Baugh et al. | 166/382 |
| 4,866,966 | A | | 9/1989 | Hagen | 72/75 |
| 4,883,121 | A | | 11/1989 | Zwart | 166/217 |
| 4,976,322 | A | | 12/1990 | Abdrakhmanov et al. | 175/57 |
| 4,997,320 | A | | 3/1991 | Hwang | 408/22 |
| 5,014,779 | A | | 5/1991 | Meling et al. | 166/55.7 |
| 5,052,483 | A | | 10/1991 | Hudson | 166/55 |
| 5,052,849 | A | | 10/1991 | Zwart | 403/300 |
| 5,109,924 | A | * | 5/1992 | Jurgens et al. | 166/117.5 |
| 5,156,209 | A | | 10/1992 | McHardy | 166/324 |
| 5,267,613 | A | | 12/1993 | Zwart et al. | 166/178 |
| 5,271,427 | A | | 12/1993 | Berchem | 175/107 |
| 5,271,472 | A | | 12/1993 | Leturno | 175/107 |
| 5,301,760 | A | | 4/1994 | Graham | 175/61 |
| 5,307,879 | A | | 5/1994 | Kent | 166/382 |
| 5,318,122 | A | * | 6/1994 | Murray et al. | 166/313 |
| 5,322,127 | A | | 6/1994 | McNair et al. | 166/313 |
| 5,348,095 | A | | 9/1994 | Worrall et al. | 166/380 |
| 5,361,859 | A | | 11/1994 | Tibbitts | 175/286 |
| 5,366,012 | A | | 11/1994 | Lohbeck | 166/277 |
| 5,409,059 | A | | 4/1995 | McHardy | 166/208 |
| 5,435,400 | A | | 7/1995 | Smith | 175/61 |
| 5,458,209 | A | * | 10/1995 | Hayes et al. | 166/117.5 |
| 5,472,057 | A | | 12/1995 | Winfree | 175/57 |
| 5,477,925 | A | * | 12/1995 | Trahan et al. | 166/117.5 |
| 5,484,021 | A | * | 1/1996 | Hailey | 166/117.5 |
| 5,520,255 | A | | 5/1996 | Barr et al. | 175/24 |
| 5,526,880 | A | * | 6/1996 | Jordan et al. | 166/291 |
| 5,553,679 | A | | 9/1996 | Thorp | 175/73 |
| 5,560,426 | A | | 10/1996 | Trahan et al. | 166/120 |
| 5,636,661 | A | | 6/1997 | Moyes | 137/614.2 |
| 5,667,011 | A | | 9/1997 | Gill et al. | 166/295 |
| 5,685,369 | A | | 11/1997 | Ellis et al. | 166/195 |
| 5,706,905 | A | | 1/1998 | Barr | 175/61 |
| 5,725,060 | A | * | 3/1998 | Blount et al. | 166/117.5 |
| 5,727,629 | A | * | 3/1998 | Blizzard et al. | 166/117.6 |
| 5,785,120 | A | | 7/1998 | Smalley et al. | 166/55 |
| 5,787,978 | A | * | 8/1998 | Carter et al. | 166/117.6 |
| 5,826,651 | A | * | 10/1998 | Lee et al. | 166/117.6 |
| 5,887,655 | A | | 3/1999 | Haugen et al. | 166/298 |
| 5,887,668 | A | | 3/1999 | Haugen et al. | 175/79 |
| 5,901,787 | A | | 5/1999 | Boyle | 166/135 |
| 5,901,789 | A | | 5/1999 | Donnelly et al. | 166/381 |
| 5,924,745 | A | | 7/1999 | Campbell | 285/90 |
| 5,957,225 | A | | 9/1999 | Sinor | 175/57 |
| 5,960,895 | A | | 10/1999 | Chevallier et al. | 175/27 |
| 5,979,571 | A | | 11/1999 | Scott et al. | 175/61 |
| 6,021,850 | A | | 2/2000 | Wood et al. | 166/380 |
| 6,024,168 | A | * | 2/2000 | Kuck et al. | 166/297 |
| 6,024,169 | A | * | 2/2000 | Haugen | 166/298 |
| 6,029,748 | A | | 2/2000 | Forsyth et al. | 166/380 |
| 6,070,671 | A | | 6/2000 | Cumming et al. | 166/381 |
| 6,098,717 | A | | 8/2000 | Bailey et al. | 166/382 |
| 6,135,208 | A | | 10/2000 | Gano et al. | 166/313 |
| 6,186,233 | B1 | * | 2/2001 | Brunet | 166/117.6 |
| 6,189,616 | B1 | | 2/2001 | Gano et al. | 166/298 |
| 6,273,190 | B1 | * | 8/2001 | Sawyer | 166/285 |
| 6,318,457 | B1 | | 11/2001 | Den Boer et al. | 166/66.7 |
| 6,318,466 | B1 | * | 11/2001 | Ohmer et al. | 166/117.6 |
| 6,405,804 | B1 | * | 6/2002 | Ohmer et al. | 166/117.6 |
| 6,419,033 | B1 | | 7/2002 | Hahn et al. | 175/61 |
| 2002/0079102 | A1 | * | 11/2001 | Dewey et al. | 166/313 |

FOREIGN PATENT DOCUMENTS

| | | | |
|---|---|---|---|
| EP | 1 006 260 | 6/2000 | E21B/43/10 |
| GB | 730 338 | 3/1954 | 84/4 |
| GB | 792 886 | 4/1956 | |
| GB | 997 721 | 7/1965 | |
| GB | 1 277 461 | 6/1972 | B21D/39/04 |
| GB | 1 448 304 | 9/1976 | E21B/33/13 |
| GB | 1 457 843 | 12/1976 | B21D/39/10 |
| GB | 1 582 392 | 1/1981 | B21D/39/10 |
| GB | 2 216 926 | 10/1989 | E21B/7/20 |
| GB | 2 320 734 | 7/1998 | E21B/33/127 |
| GB | 2 329 918 | 4/1999 | E21B/43/10 |
| GB | 2 333 542 A | 7/1999 | E21B/10/26 |

| | | | |
|---|---|---|---|
| GB | 2 335 217 | 9/1999 | ..... E21B/29/06 |
| WO | WO 92/01139 | 1/1992 | ..... E21B/17/08 |
| WO | WO 93/24728 | 12/1993 | ..... E21B/17/10 |
| WO | WO 93/25800 | 12/1993 | ..... E21B/43/10 |
| WO | WO 94/25655 | 11/1994 | ..... D04C/1/06 |
| WO | WO 96/28635 | 9/1996 | ..... E21B/17/14 |
| WO | WO 97/21901 | 6/1997 | ..... E21B/17/08 |
| WO | WO 98/00626 | 1/1998 | ..... E21B/43/10 |
| WO | WO 98/09053 | 3/1998 | ..... E21B/33/14 |
| WO | WO 99/02818 | 1/1999 | ..... E21B/43/10 |
| WO | WO 99/18328 | 4/1999 | ..... E21B/23/01 |
| WO | WO 99/23354 | 5/1999 | ..... E21B/43/10 |
| WO | WO 99/50528 | 10/1999 | ..... E21B/29/06 |
| WO | WO 99/64713 | 12/1999 | ..... E21B/7/20 |
| WO | WO 01/83932 A1 | 11/2001 | ..... E21B/7/20 |

OTHER PUBLICATIONS

Hahn, et al., Patent Application Publication No. US 2003/0056991, Filed Jul. 12, 2002, Published Mar. 27, 2003 Entitled: Apparatus and Method for Simultaneous Drilling and Casing Wellbores.

PCT International Search Report from PCT/GB 01/01966, Dated Sep. 18, 2001.

Detlef Hahn, et al. "Simultaneous Drill and Case Technology—Case Histories, Status and Options for Further Development," Society of Petroleum Engineers, IADC/SPE Drilling Conference, New Orleans, LA, Feb. 23–25, 2000, pp. 1–9.

Metcalfe, P.—"Expandable Slotted Tubes Offer Well Design Benefits", *Petroleum Engineer International*, vol. 69, No. 10(Oct. 1996), pp. 60–63—XP000684479.

PCT International Preliminary Examination Report from PCT/GB99/04365, Dated Mar. 23, 2001.

Partial International Search Report from PCT/GB00/04160, Dated Feb. 2, 2001.

The Patent Office, UK Search Report from GB 9930398.4, Dated Jun. 27, 2000.

PCT International Search Report from PCT/GB99/04246, Dated Mar. 3, 2000.

The Patent Office, UK Search Report from GB 9930166.5, Dated Jun. 12, 2000.

U.S. patent application Ser. No. 09/554,677, Rudd filed Nov. 19, 1998.

U.S. patent application Ser. No. 09/530,301, Metcalfe, filed Nov. 2, 1998.

U.S. patent application Ser. No. 09/470,176, Metcalfe et al., filed Dec. 22, 1999.

U.S. patent application Ser. No. 09/470,154, Metcalfe et al., filed Dec. 22, 1999.

U.S. patent application Ser. No. 09/469,692, Trahan et al., filed Dec. 22, 1999.

U.S. patent application Ser. No. 09/469,690, Abercrombie, filed Dec. 22, 1999.

U.S. patent application Ser. No. 09/469,681, Metcalfe et al., filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

U.S. patent application Ser. No. 09/426,654, Metcalfe, filed Jul. 13, 1998.

* cited by examiner

FIG.4C
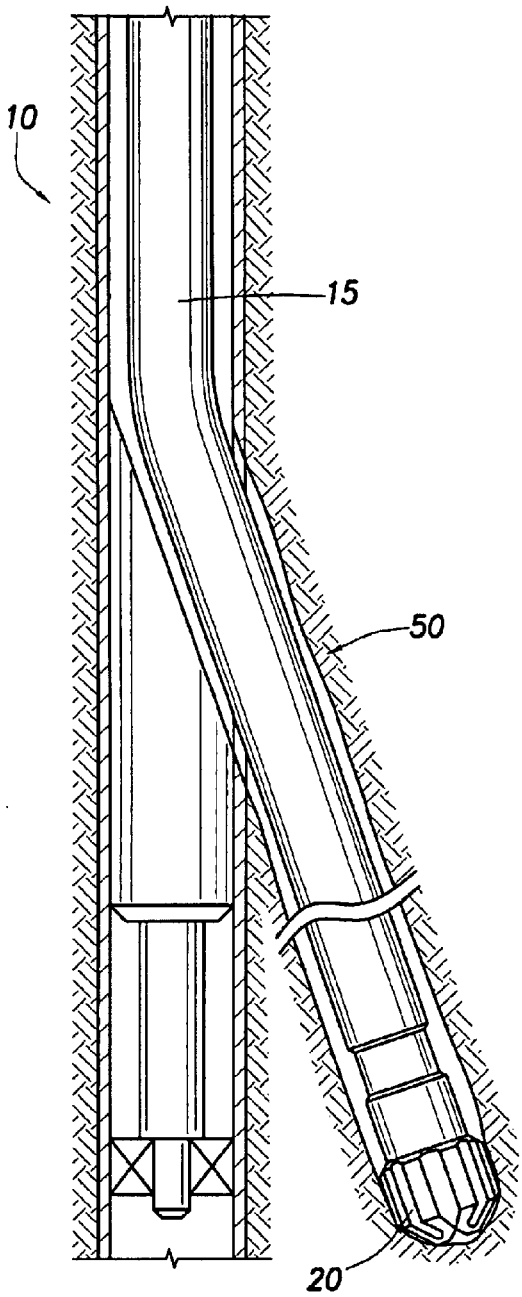
FIG.5A
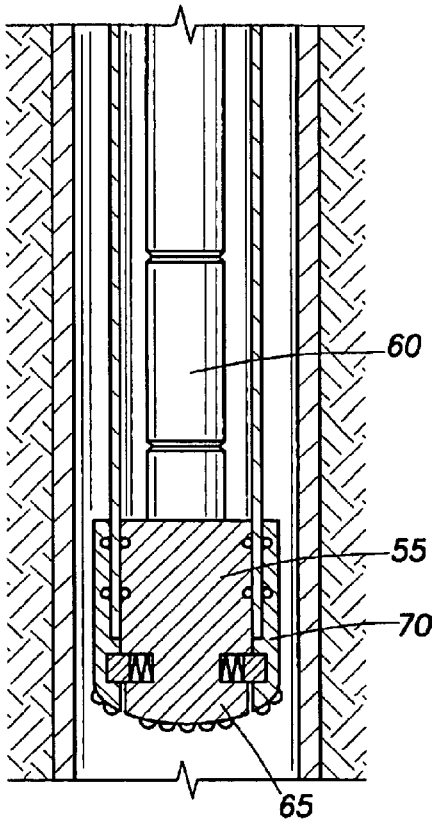
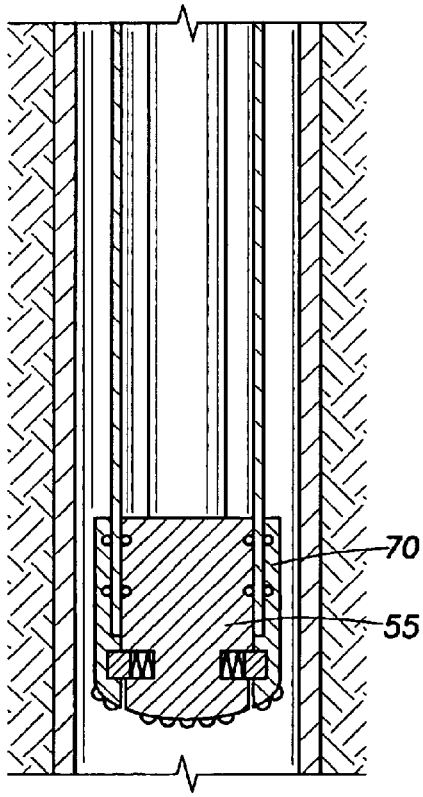
FIG.5B

APPARATUS AND METHODS FOR FORMING A LATERAL WELLBORE

CROSS-REFERENCE TO RELATED APPLICATIONS

This application claims benefit of U.S. provisional patent application Ser. No. 60/202,335, filed May 5, 2000, which is herein incorporated by reference.

BACKGROUND OF THE INVENTION

1. Field of the Invention

The present invention relates to methods and apparatus for forming a lateral wellbore in a well, more particularly the invention relates to the formation of lateral wellbores with greater efficiently and with fewer trips into the wellbore.

2. Background of the Related Art

The formation of lateral wellbores from a central cased wellbore is well known in the art. Lateral wellbores are typically formed to access an oil bearing formation adjacent the existing wellbore; provide a perforated production zone at a desired level; provide cement bonding between a small diameter casing and the adjacent formation; or to remove a loose joint of surface pipe. Lateral wellbores are advantageous because they allow an adjacent area of the formation to be accessed without the drilling of a separate wellbore from the surface. Any number of lateral wellbores may be formed in a well depending upon the needs and goals of the operator and the lateral wellbores can be lined with tubular like the main wellbore of the well from which they are formed.

The most well known method of forming a lateral wellbore uses a diverter or whipstock which is inserted into the main wellbore and fixed therein. The whipstock includes a concave, slanted portion which forms a surface for gradually directing a cutting device from the main wellbore of the well towards the wall of the wellbore where the lateral wellbore will be formed. The cutter is fixed at the end of a string of rotating pipe. Thereafter, an opening or "window" is formed in the wellbore casing as the cutter is guided through the wall by the whipstock. Forming a lateral wellbore with a whipstock assembly typically proceeds as follows: a whipstock assembly including an anchor portion therebelow is lowered into the well to the area below the point where the window is to be formed. The assembly is then fixed in the well with the anchor securely held within the wellbore casing. A drill string with a cutting tool disposed at the end thereof is then lowered into the well and the drill string and cutter are rotated in order to form the window in the wellbore. In some instances, the drill string and cutter can be installed in the well at the same time as the whipstock assembly by attaching the two with a shearable mechanical connection between the whipstock and the cutter. Thereafter, the cutter and drill string are removed from the well and the cutter is replaced with a drill bit. The drill string and drill bit are then lowered once more into the wellbore and the lateral wellbore is drilled using the conventional drill bit. After the lateral wellbore is formed, it is typically lined with its own casing which is subsequently cemented in place.

As the foregoing demonstrates, the formation of a lateral wellbore requires several separate pieces of equipment and more importantly, requires several trips into the well to either install or remove the downhole apparatus used to form the window or the lateral wellbore.

There are a number of apparatus currently available which, are designed to simplify or save time when performing operations in a wellbore. For example, a "mill/drill" is a special bit specifically designed to both mill through a casing and drill into a formation. Use of a mill/drill can eliminate the use of a separate mill and drill bit in a lateral wellbore operation and therefore eliminate the need to pull the mill out of the wellbore after forming the window in order to install the drill bit to form the lateral wellbore. Typically, the mill/drill includes materials of different physical characteristics designed to cut either the metallic material of the wellbore casing to form a window or designed to cut rock in formation material as the lateral wellbore is formed. In one example, inserts are installed in the drill bit whereby one set of inserts includes a durable cutting structure such as tungsten carbide for contacting and forming the window in the wellbore casing and a second set of inserts is formed of a harder material better suited for drilling through a subterranean formation, especially a rock formation. The first cutting structure is positioned outwardly relative to the second cutting structure so that the first cutting structure will mill through the metal casing while shielding the second cutting structure from contact with the casing. The first cutting structure can wear away while milling through the casing and upon initial contact with the rock formation, thereby exposing the second cutting structure to contact the rock formation. Combination milling and drill bits such as the foregoing are described in U.S. Pat. Nos. 5,979,571 and 5,887,668 and those patents are incorporated herein by reference in their entirety.

Another recent time saving improvement for downhole oil well operations involves the drilling of a wellbore using the tubular, or liner which will subsequently form the casing of the wellbore. This method of "drilling with liner" avoids the subsequent procedure of inserting liner into a previously drilled wellbore. In its simplest form, a drill bit is disposed at the end of a tubular that is of a sufficient diameter to line the wall of the borehole being formed by the drill at the end thereof. Once the borehole has been formed and the liner is ready to be cemented in the borehole, the drill bit at the end thereof is either removed or simply destroyed by the drilling of a subsequent, smaller diameter borehole.

Drilling with liner can typically be performed two ways: In the first method, the liner string itself with the drill bit fixed at the end thereof rotates. In a second method, the liner string is non-rotating and the drill bit, disposed at the end of the liner string and rotationally independent thereof, is rotated by a downhole motor or by another smaller diameter drill stem disposed within the liner that extends back and is rotated from the surface. In one example of a non-rotating liner, the bit includes radially extendable and retractable arms which extend outwards to a diameter greater than the tubular during drilling but are retractable through the inside diameter of the tubular whereby, when the wellbore is completed, the bit can be completely removed from the wellbore using a wireline device. The foregoing arrangement is described in U.S. Pat. No. 5,271,472 and that reference is incorporated herein in its entirety.

In another example of drilling with liner, a non-rotating tubular is used with a two-part bit having a portion rotating within the end of the tubular and another portion rotating around the outer diameter of the tubular. The rotation of each portion of the bit is made possible either by a downhole motor or by rotational force supplied to a separate drill stem from the surface of the well. In either case, the central portion of the bit can be removed after the wellbore has been formed. The liner remains in the wellbore to be cemented therein. A similar arrangement is described in U.S. Pat. No. 5,472,057 and that patent is incorporated herein by reference in its entirety.

Yet another emerging technology offering a savings of time and expense in drilling and creating wellbores, relates to rotary steerable drilling systems. These systems allow the direction of a wellbore to be changed in a predetermined manner as the wellbore is being formed. For example, in one well-known arrangement, a downhole motor having a joint within the motor housing can create a slight deviation in the direction of the wellbore as it is being drilled. Fluid-powered motors have been in use in drilling assemblies in the past. These designs typically utilize a fixed stator and a rotating rotor, which are powered by fluid flow based on the original principles developed by Moineau. Typical of such single-rotor, progressive cavity downhole motor designs used in drilling are U.S. Pat. Nos. 4,711,006 and 4,397,619, incorporated herein in their entirety. The stator in Moineau motors is built out of elastic material like rubber. Other designs have put single-rotor downhole power sections in several components in series, with each stage using a rotor connected to the rotor of the next stage. Typical of these designs are U.S. Pat. Nos. 4,011,917 and 4,764,094, incorporated herein in their entirety.

Another means of directional drilling includes the use rotary steerable drilling units with hydraulically operated pads formed on the exterior of a housing near the drill bit. The mechanism relies upon a MWD device (measuring while drilling) to sense gravity and use the magnetic fields of the earth. The pads are able to extend axially to provide a bias against the wall of a borehole or wellbore and thereby influence the direction of the drilling bit therebelow. Rotary steerable drilling is described in U.S. Pat. Nos. 5,553,679, 5,706,905 and 5,520,255 and those patents are incorporated herein by reference in their entirety.

Technology also exists for the expansion of tubulars in a wellbore whereby a tubular of a first diameter may be inserted into a wellbore and later expanded to a greater inside and outside diameter by an expansion tool run into the wellbore on a run-in string. The expansion tool is typically hydraulically powered and exerts a force on the inner surface of the tubular when actuated.

FIGS. 1 and 2 are perspective views of the expansion tool 100 and FIG. 3 is an exploded view thereof. The expansion tool 100 has a body 102 which is hollow and generally tubular with connectors 104 and 106 for connection to other components (not shown) of a downhole assembly. The connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 100 to the exterior of the respective land 112. Each of the mutually identical rollers 116 is near-cylindrical and slightly barreled. Each of the rollers 116 is mounted by means of a bearing 118 at each end of the respective roller for rotation about a respective rotational axis which is parallel to the longitudinal axis of the tool 100 and radially offset therefrom at 120-degree mutual circumferential separations around the central body 108. The bearings 118 are formed as integral end members of radially slidable pistons 120, one piston 120 being slideably sealed within each radially extended recess 114. The inner end of each piston 120 (FIG. 3) is exposed to the pressure of fluid within the hollow core of the tool 100 by way of the radial perforations in the tubular core 115. In the embodiment shown in FIGS. 1–3, the expander tool is designed to be inserted in a tubular string. It can however, also be used at the end of a tubular string with fluid passing through it via ports formed in its lower end.

After a predetermined section of the tubular has been expanded to a greater diameter, the expansion tool can be deactivated and removed from the wellbore. Methods for expanding tubulars in a wellbore are described and claimed in Publication No. PCT/GB99/04225 and that publication is incorporated by reference in its entirety herein.

There is a need therefore for methods and apparatus for forming a lateral wellbore whereby subsequent trips into the main wellbore are minimized and wherein the wellbore can be formed in a faster, more efficient manner utilizing less time, equipment and personnel. There is a further need for a method of forming a lateral wellbore which utilizes various apparatus which have been developed for unrelated activities in a wellbore.

SUMMARY OF THE INVENTION

The present invention generally provides a method and system of coupling a steerable system, such as a rotary steerable system, to a mill/drill to drill a lateral wellbore. The mill/drill is suitable for milling through a casing, such as a steel casing, and drilling through an underground formation. The method and system can include a diverter, such as a whipstock, for directing the mill/drill toward the casing on the wellbore.

In one aspect, a method of drilling a lateral hole with a liner is provided, comprising inserting a liner coupled to a rotary steerable system and a mill/drill into a wellbore having a casing disposed therein, directing the mill/drill toward a wall of the casing, cutting a window in the casing with the mill/drill, drilling into a formation using the mill/drill to form a lateral hole while advancing the liner attached to the mill/drill into the lateral hole, and leaving at least a portion of the liner in the lateral hole after the lateral hole is drilled. In another aspect, method of drilling a lateral with a liner is provided, comprising inserting a liner coupled to a mill/drill into a wellbore having a casing inserted therein, directing the mill/drill toward a wall of the casing, cutting a window in the casing with the mill/drill, drilling into a formation using the mill/drill to form a lateral hole while advancing the liner attached to the mill/drill into the lateral hole, and leaving at least a portion of the liner in the lateral hole after the lateral hole is drilled. In another aspect, a method of drilling a lateral hole in a wellbore is provided, comprising inserting a rotary steerable system coupled to a mill/drill into a wellbore, the wellbore having a casing inserted therein, directing the mill/drill toward a wall of the casing, cutting a window in the casing with the mill/drill, and drilling into a formation using the mill/drill to form a lateral hole while advancing the rotary steerable system attached to the mill/drill into the lateral.

In another aspect, a system for drilling a lateral hole in a wellbore is provided, comprising a means for inserting a rotary steerable system attached to a mill/drill into a wellbore having a casing disposed therein, a means for directing the mill/drill toward a wall of the casing, a means for cutting a window in the casing with the mill/drill, a means for drilling into a formation using the mill/drill to form a lateral hole while advancing the rotary steerable system into the lateral hole, and a means for leaving at least a portion of the rotary steerable system in the lateral hole after the lateral hole is drilled. Further, in another aspect, a system for drilling a lateral hole in a wellbore is provided, comprising a means for inserting a liner attached to a mill/drill into a wellbore having a casing inserted therein, a means for directing the mill/drill toward a wall of the casing, a means for cutting a window in the casing with the mill/drill, a means for drilling into a formation using the mill/drill to form a lateral hole while advancing the liner attached to the mill/drill into the lateral hole, and a means for leaving at least a portion of the liner in the lateral hole after the lateral hole is drilled.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 4C is a section view of a wellbore depicting a lateral wellbore having been formed and the liner having lined the interior thereof.

FIG. 5A is a section view of a wellbore with a liner therein and an independently rotating, two-part mill/drill disposed thereupon, rotation of the mill/drill provided by a motor thereabove.

FIG. 5B is a section view of a wellbore with a liner therein and an independently rotating two-part mill/drill disposed thereupon.

DETAILED DESCRIPTION OF THE PREFERRED EMBODIMENT

Figure 4A:
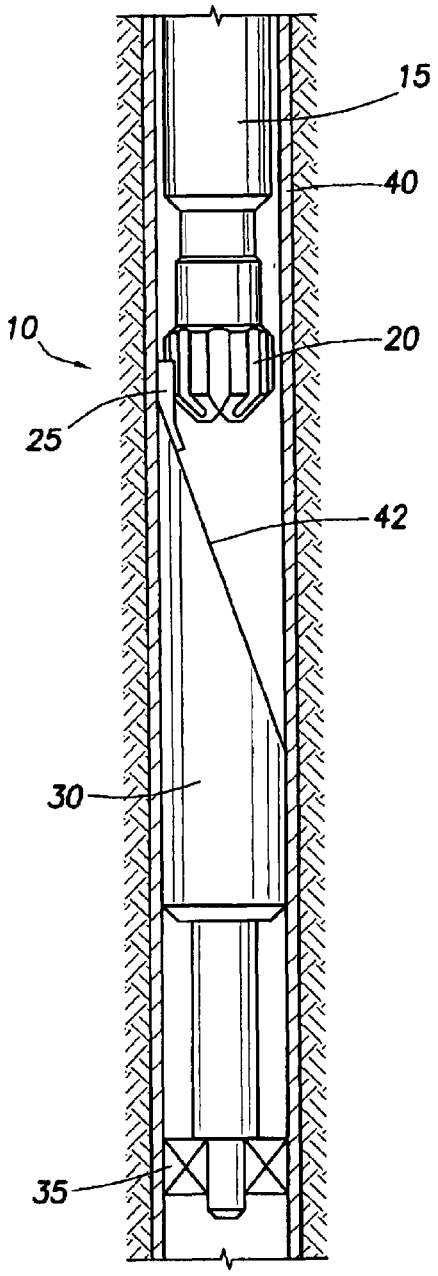
FIG. 4A is a section view of a cased wellbore having a liner inserted therein with a mill/drill disposed on the end thereof, the mill/drill connected by a shearable connection to a whipstock and anchor assembly therebelow.

FIG. 4A is a section view of a cased wellbore 10 having a liner 15 disposed therein and a mill/drill 20 disposed at the end thereof. A shearable connection 25 between the mill/drill and a diverter, in this case a whipstock 30, therebelow allows the entire assembly, including an anchor 35, to be run into the wellbore at once. The anchor 35 is located below the whipstock and fixes the whipstock in place allowing the mill/drill 20 to form a window at a predetermined point in the wall of the casing 40 as it rotates along a concave portion 42 of the whipstock 30. After the assembly is run into the wellbore and the whipstock 30 and anchor 35 are fixed in place, a downward force is applied to the liner 15 and mill/drill 20 to cause the shearable connection 25 between the mill/drill and the whipstock to fail. The mill/drill can then be rotated and formation of the window can begin. In the embodiment shown in FIG. 4A, the mill/drill 20 is rotationally fixed to the end of the liner 15 and rotational force is applied to the liner at the well surface.

Figure 4B:
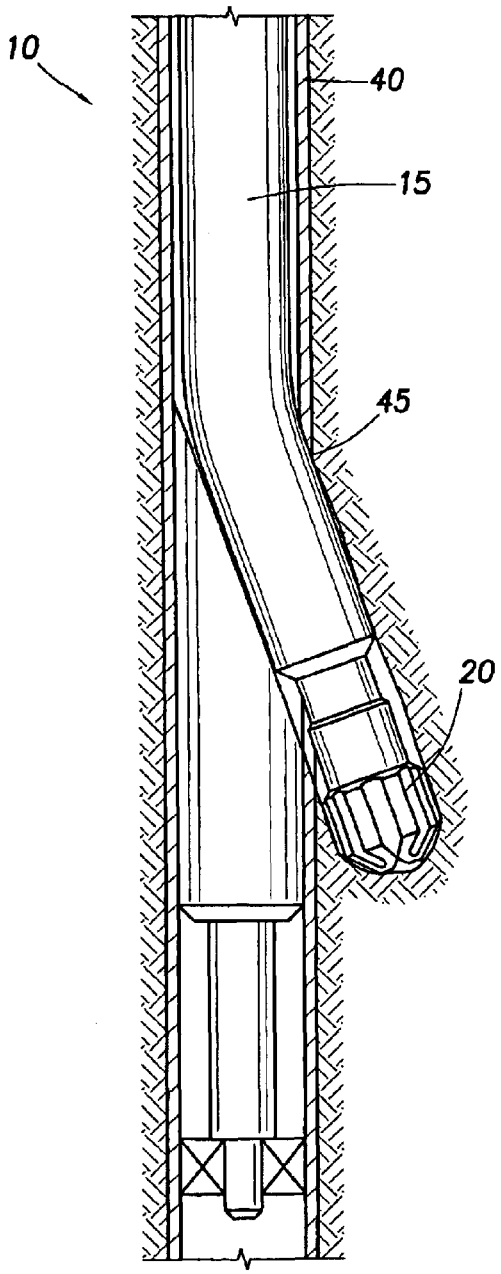
FIG. 4B is a section view of a wellbore illustrating a window formed in the wellbore casing by the rotating liner and the mill/drill.

FIG. 4B is a section view of the wellbore illustrating a window 45 that has been formed in the casing wall 40 by the rotating mill/drill 20. FIG. 4B also illustrates the liner 15 having advanced through the window 45 and into the lateral wellbore. FIG. 4C, a section view of the wellbore 10, shows the lateral wellbore 50 formed and lined with the liner 15 which was inserted into the lateral wellbore as it was formed. In the embodiment illustrated, the mill/drill 20 remains at the end of the liner 15 after the lateral wellbore 50 is formed and can be subsequently destroyed by additional drilling. To complete the lateral wellbore, portions of the liner extending into the central wellbore from the window may be removed. Techniques for cutting off that portion of a liner extending into and blocking a vertical wellbore are described in U.S. Pat. Nos. 5,301,760 and 5,322,127 and those patents are incorporated herein by reference in their entirety.

In an alternative embodiment of the arrangement depicted in FIGS. 4A–C, the liner 15 with the mill/drill disposed thereupon can be non-rotating and a two-piece drill/mill 55 rotates independently of the liner 15 with rotational forces supplied by a downhole motor within the liner or by a rotational device located at the surface of the well. For example, FIG. 5A is a section view of a two-piece mill/drill 55 with rotational force provided thereto by a downhole motor 60 and FIG. 5B is a view of the two-piece mill/drill 55 with rotational force provided from the well surface (not shown). A first portion 65 of the two-piece mill/drill 55 has an outer diameter smaller than the inside diameter of the liner and a second portion 70 of the mill/drill 55 extends around the perimeter of the liner and is rotationably coupled to the first portion 65. After the lateral wellbore has been formed, the portions 65, 70 of the mill/drill 55 can be disconnected from each other and the first portion 65 may be removed from the lateral wellbore with a wireline or any other well-known technique for recovering downhole devices from a wellbore.

Figure 1:
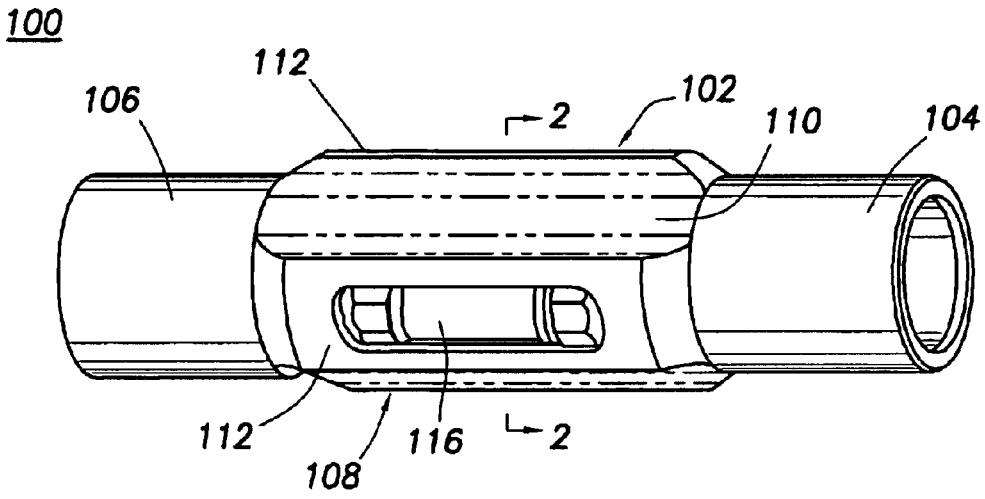
FIG. 1 (PRIOR ART)
FIG. 1 is a perspective view of an expansion tool.
Figure 2:
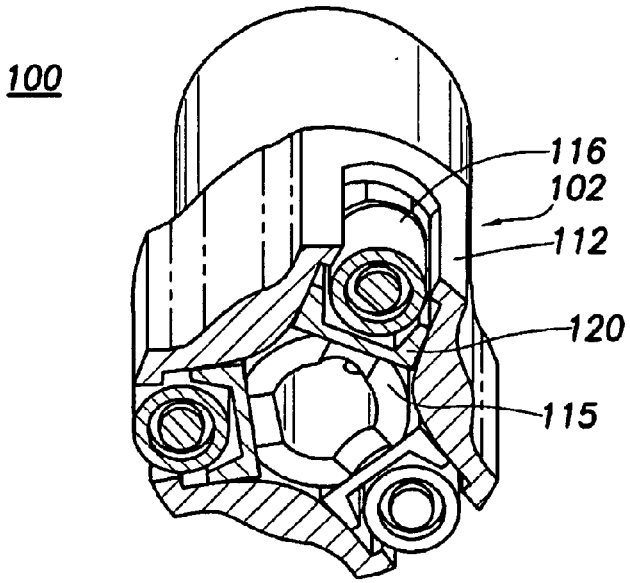
FIG. 2 (PRIOR ART)
FIG. 2 is a perspective end view in section thereof.
Figure 3:
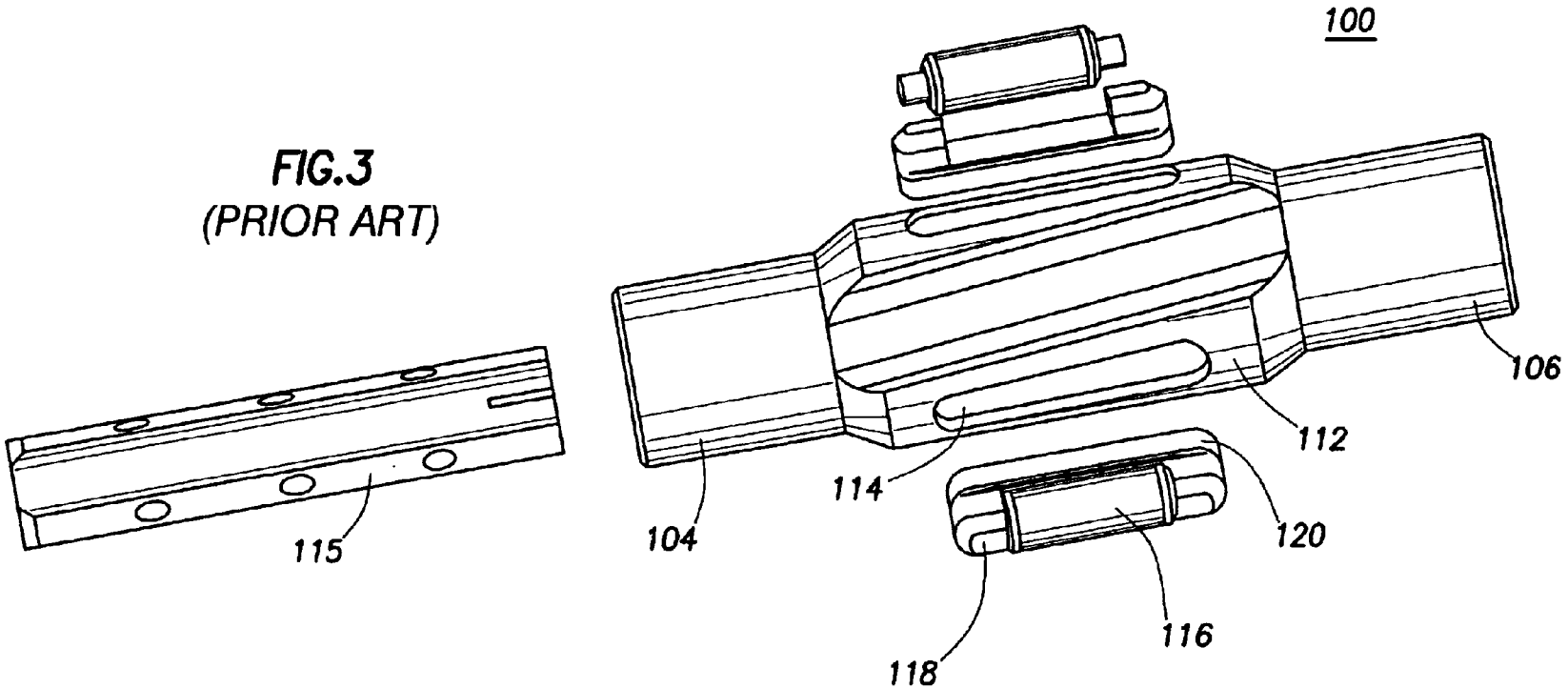
FIG.3 (PRIOR ART)
FIG. 3 is an exploded view of the expansion tool.
Figure 6A:
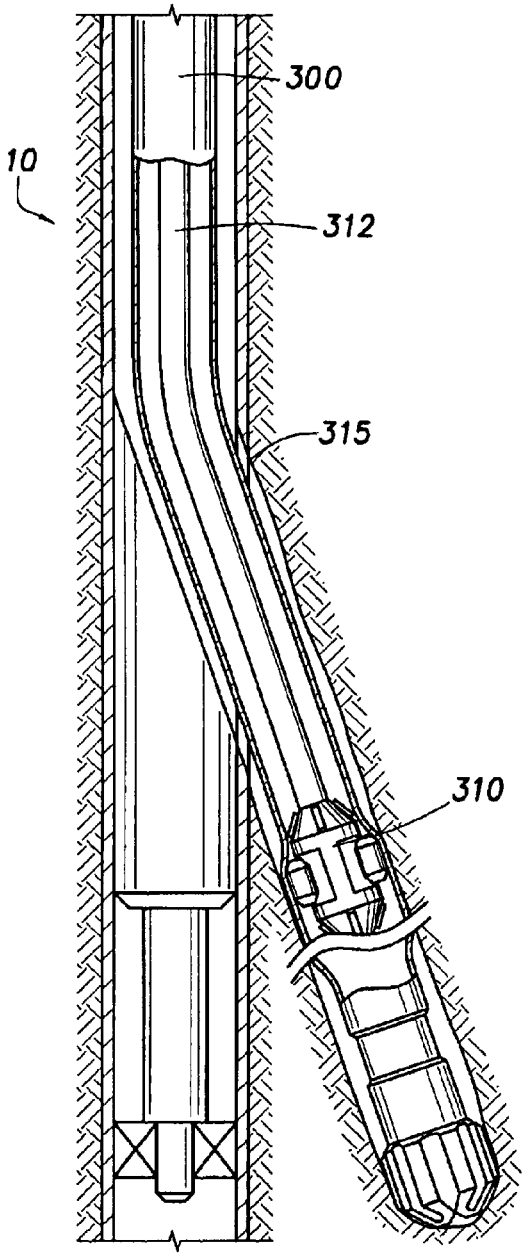
FIG. 6A is a section view of a wellbore with a selective expansion tool disposed therein.
Figure 6B:
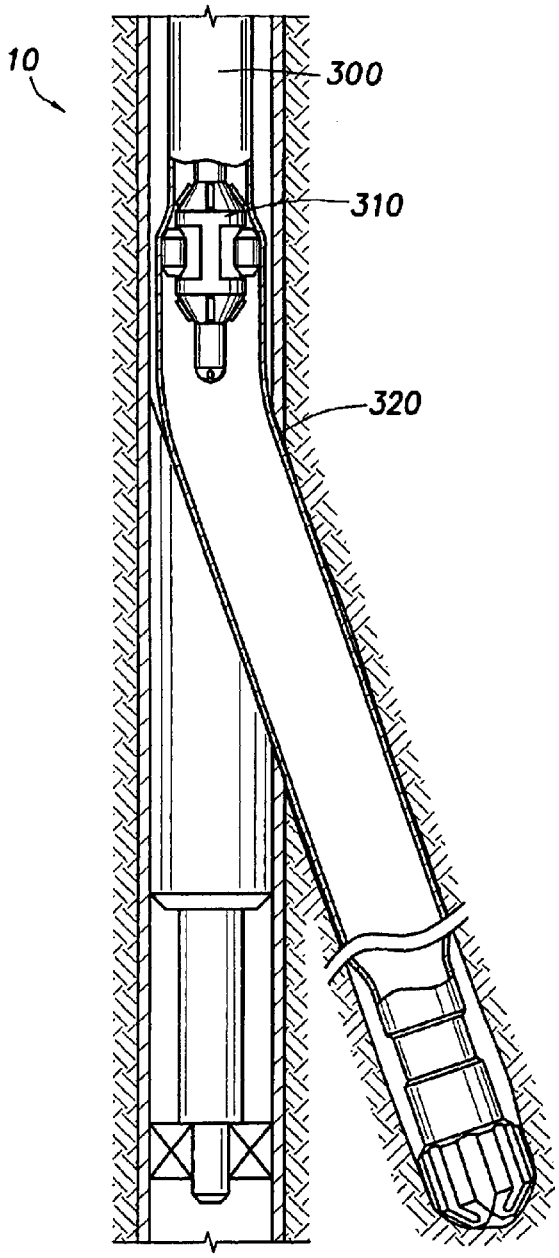
FIG. 6B is a section view of the wellbore with the liner having been expanded into and sealing the window of the well casing.

When drilling a lateral wellbore with liner, undersized liner may be used during the formation of the lateral wellbore to facilitate the operation and thereafter, when the wellbore is formed, the liner can be expanded to increase its diameter to more closely match the inside diameter of the lateral wellbore. Enlargement of the liner is typically accomplished by insertion of a selective expansion device into the lateral wellbore and subsequent actuation of the device which places an outward force on the wall of the liner. Moving the actuated device axially in the liner creates a section of enlarged liner. FIG. 6A is a section view of a lateral wellbore 10 drilled with liner 300 and having a selective expansion tool 310 inserted therein on a separate tubular string 312 for enlarging the diameter of the liner. In the figure, the selective expansion tool 310 is run into the lateral wellbore where it is then actuated and urged towards the window 315 of the wellbore, enlarging the liner to a size adequate to line the lateral wellbore for cementing therein. Compliant rollers 116 (FIG. 1) of the expansion tool 310 may alternatively be cone-shaped to facilitate a gradual enlargement of the liner as the expansion tool moves therethrough. In FIG. 6B, another section view of a lateral wellbore 10, the undersized liner 300 has been expanded up to and through the window in the vertical casing in a manner that has sealed an annular area 320 between the exterior of the liner and the window opening. After removal of the selective expansion tool 310, the liner 300 can be severed at the window leaving a sealed lateral wellbore extending from the central wellbore.

Figure 7A:
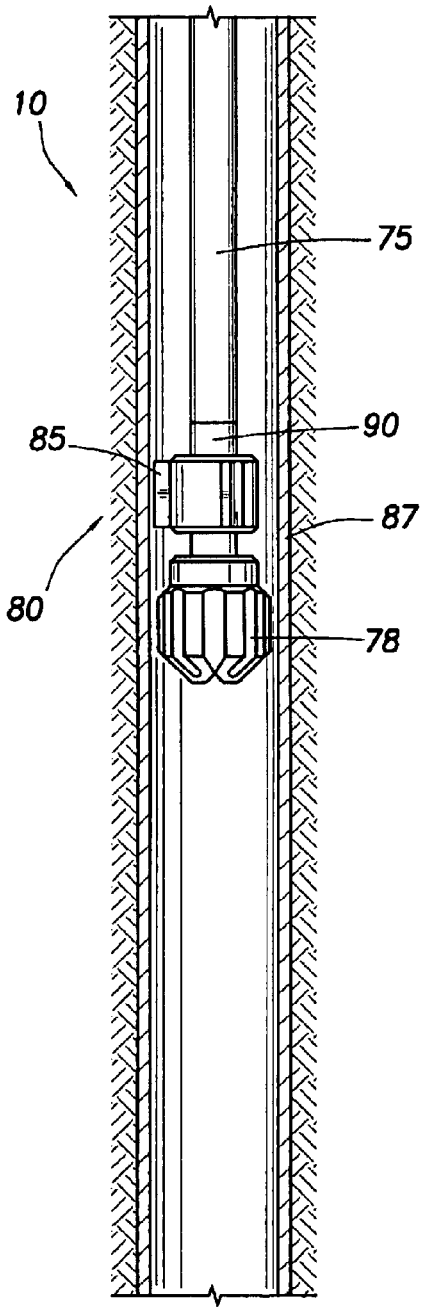
FIG. 7A is a section view of a wellbore having a drill stem with a MWD device, rotary steerable mechanism and a mill/drill disposed thereon.

FIG. 7A is a section view of a wellbore 10 having a conventional drill stem 75 for providing rotational force to a mill/drill 78 disposed at the end thereof. A rotary steerable mechanism 80 is installed above the mill/drill and includes selectively radially extendable pads 85 which can transmit a force against the casing wall causing the mill/drill therebelow to be diverted towards the opposite wall of the casing. A measurement while drilling device (MWD) 90 is installed within the tubular string to provide orientation.

Figure 7B:
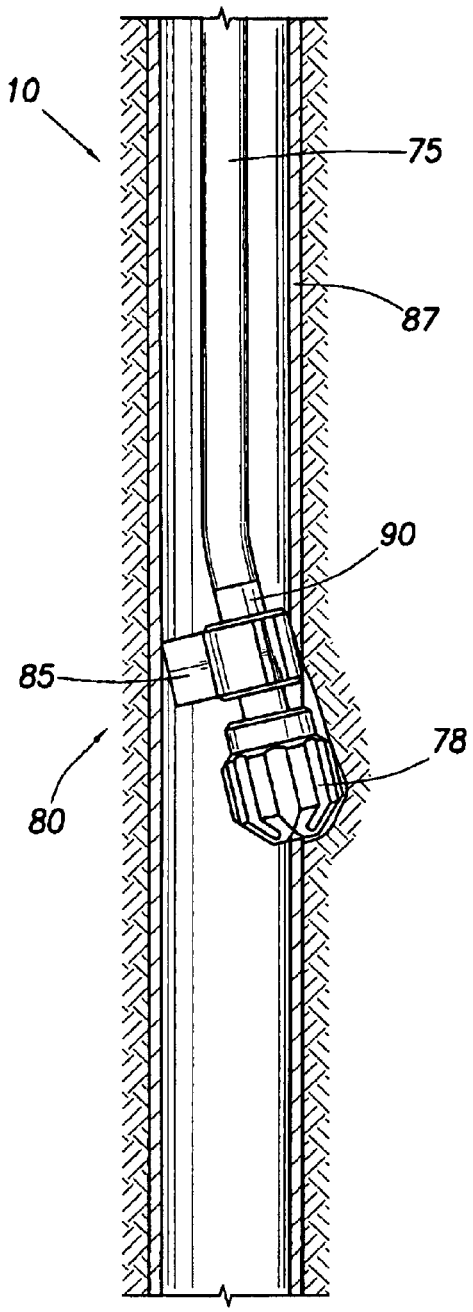
FIG. 7B is a section view of a wellbore illustrating the rotary steerable mechanism having biased the mill/drill to form a window in the casing wall of the wellbore.

As illustrated in FIG. 7B, the assembly including the MWD 90, steerable mechanism 80 and mill/drill 78 is run into the wellbore 10 to a predetermined depth and, thereafter, at least one pad 85 of the rotary steerable mechanism 80 is actuated to urge the mill/drill 78 against that area of the casing wall 87 where the window will be formed. After the window has been formed by the mill/drill 78, the assembly extends into the window and the lateral wellbore is formed. Upon completion of the lateral wellbore the assembly is removed from the well and the new lateral wellbore may be lined with tubular liner in a conventional manner well known in the art.

Figure 8:
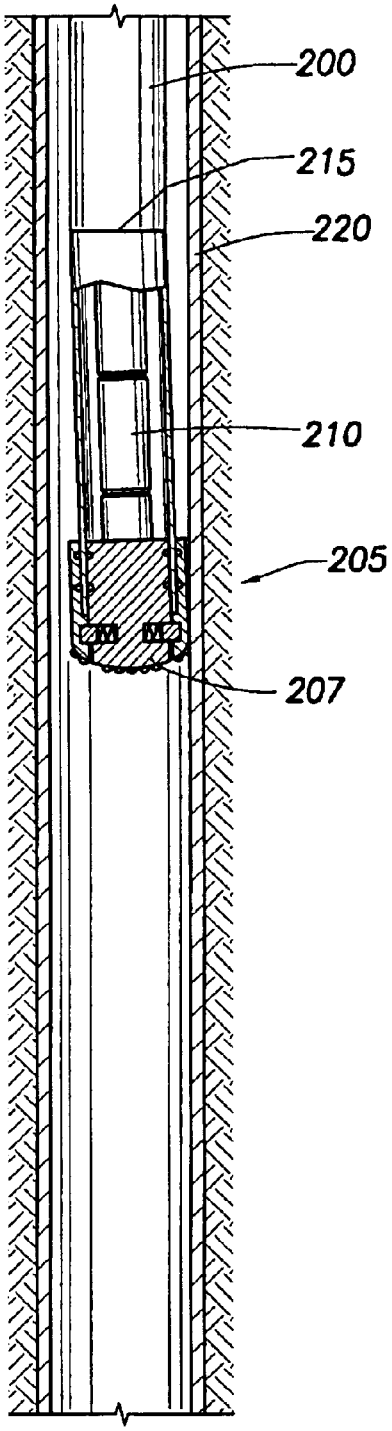
FIG. 8 is a section view of a wellbore showing a non-rotating, bent liner with a rotationally independent, two-piece mill/drill disposed thereon.

FIG. 8 is a section view of a wellbore 10 wherein a liner 200 is provided with a two-piece mill/drill 205 disposed at the end thereof, the liner having a bent portion 215 at the lower end which directs the mill/drill 205 to a predetermined area of the wellbore casing 220 where a window will be formed. In this embodiment, the liner is non-rotating and the mill/drill 205 rotates independently thereof, powered by either a downhole motor 210 thereabove or a rotary unit located at the surface of the well (not shown). To cooperate with the bent liner portion, downhole motor 210 may have a bent housing. As described herein, the mill/drill is a two-piece assembly with a center portion 207 that can be removed when the formation of the lateral wellbore is complete.

Figure 9:
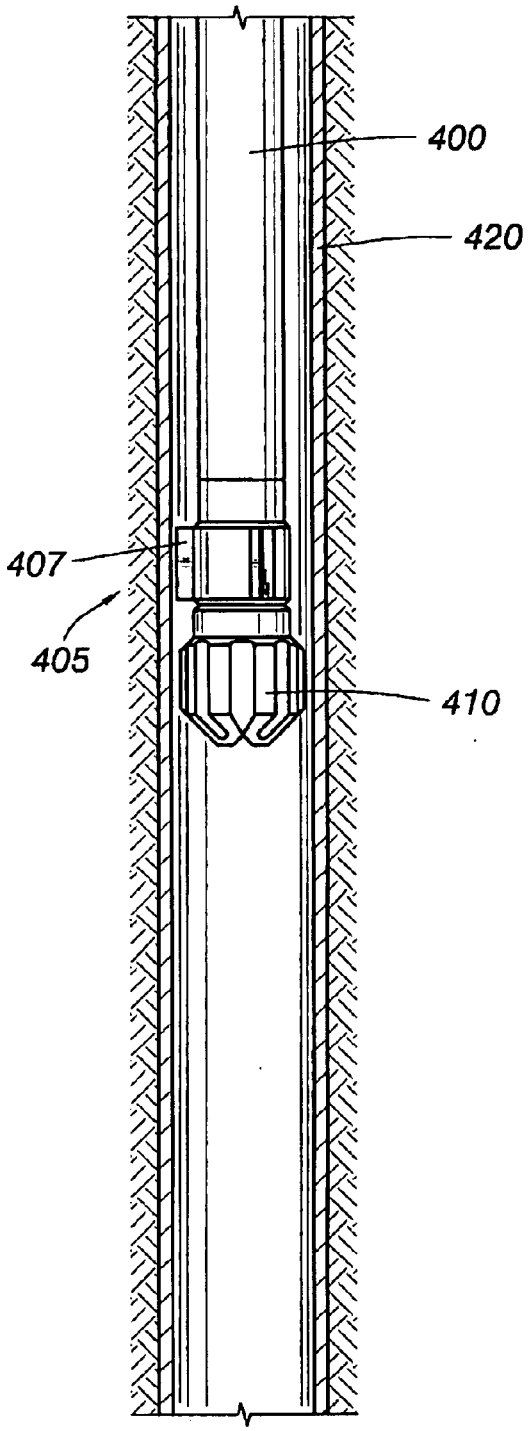
FIG. 9 is a section view of a wellbore with a rotating liner disposed therein, the rotating liner having a rotary steerable unit and a mill/drill disposed at the end thereof.

In another embodiment depicted in FIG. 9, a rotating straight liner 400 is provided with a rotary steerable mechanism 405 and a mill/drill 410 disposed at a lower end thereof. The rotary steerable mechanism 405, like those described herein has selectively extendable pads 407 which exert a force against the casing wall 420, of the central wellbore, biasing the mill/drill 410 therebelow in a direction where the window is to be formed in the casing wall and formation of the lateral wellbore is to begin.

In this embodiment, the assembly is lowered into the well to a predetermined depth and thereafter, the liner 400 and mill/drill 410 rotate as the mill/drill 410 is urged against the wall of the casing 420 biased by the rotary steerable mechanism 405. The mill/drill 410 forms a window in the casing and then the assembly, including the rotating liner 400, is urged through the window and the lateral wellbore is formed. After the wellbore is formed, an MWD device (not shown) which is located on a separate tubular string within the liner is removed and the fixed mill/drill is left in the lateral wellbore.

While foregoing is directed to the preferred embodiment of the present invention, other and further embodiments of the invention may be devised without departing from the basic scope thereof, and the scope thereof is determined by the claims that follow.

What is claimed is:

1. A method of using a liner to drill a lateral wellbore of a well, comprising:

a) inserting the liner having a mill/drill disposed at one end into a wellbore having a wall therein;

b) directing the mill/drill towards a pre-selected area of the wall;

c) cutting an opening in the wall with the mill/drill;

d) drilling into a formation proximate the opening while advancing the liner to form the lateral wellbore; and e) leaving at least a portion of the liner in the lateral wellbore.

2. The method of claim 1, wherein the wall is cased with a casing.

3. The method of claim 1, wherein the liner and the mill/drill are rotationally coupled.

4. The method of claim 1, wherein the liner and mill/drill are rotationally independent and rotation of the mill/drill is provided by a downhole motor disposed thereabove.

5. The method of claim 1, wherein the mill/drill comprises an inner portion and an outer portion, the inner portion being selectively removable from the outer portion of the mill/drill.

6. The method claim 5, further comprising:

a) removing at least one portion of the mill/drill;

b) replacing the portion of the mill/drill;

c) inserting the replaced portion in the liner; and d) continuing to advance the liner.

7. The method of claim 1, wherein the rotation of the mill/drill is provided by a rotational force at a surface of the well.

8. The method of claim 1, wherein directing the mill/drill towards the pre-selected area of the wall is performed by a diverter fixed in the wellbore therebelow.

9. The method of claim 8, wherein directing the mill/drill toward the wall comprises:

a) selectively coupling the diverter to the mill/drill;

b) fixing the diverter at a predetermined location in the wellbore;

c) disengaging the coupling between the diverter and the mill/drill;

d) diverting the mill/drill along a slanted surface of the diverter toward the wall to cut the opening.

10. The method of claim 1, further comprising removing at least a portion of the liner extending into the wellbore from the opening.

11. The method of claim 1, further comprising expanding at least a portion of the liner within the lateral wellbore.

12. The method of claim 11, wherein the liner is expanded into a contacting relationship with the opening.

13. The method of claim 12, wherein the liner is expanded into a sealing relationship with the opening.

14. The method of claim 1, further comprising directing the mill/drill by using a bent liner.

15. A method of using a liner to drill a lateral wellbore, comprising:

a) inserting the liner coupled to a rotary steerable system and a mill/drill into a wellbore having a wall therein;

b) directing the mill/drill towards a pre-selected area of the wall;

c) cutting an opening in the wall with the mill/drill;

d) drilling into a formation proximate the opening while advancing the liner to form the lateral wellbore; and e) leaving at least a portion of the liner in the lateral wellbore after the lateral wellbore is drilled.

16. The method of claim 15, wherein the liner and the mill/drill are rotationally coupled.

17. The method of claim 15, further comprising removing at least a portion of the liner extending into the wellbore from the opening.

18. The method of claim 15, wherein directing the mill/drill toward the wall comprises using a diverter.

19. The method of claim 15, further comprising leaving the mill/drill in the lateral wellbore and drilling out the mill/drill for insertion of a subsequent cutting tool coupled to a subsequent liner.

20. The method of claim 15, further comprising cutting an opening in the liner advanced in the lateral wellbore and drilling a branch wellbore at an angle to the lateral wellbore.

21. The method of claim 15, further comprising coupling an MWD tool to the liner.

22. The method of claim 21, further comprising disposing the MWD tool radially inward from an outside surface of the liner.

23. The method of claim 21, wherein the MWD tool is retrievable while the liner remains in the wellbore.

24. A system of using a liner to drill a lateral wellbore of a well, comprising:

a) an apparatus for inserting the liner having a mill/drill disposed at one end into a wellbore having a wall therein;

b) an apparatus for directing the mill/drill towards a pre-selected area of the wall;

c) an apparatus for cutting an opening in the wall with the mill/drill; and d) an apparatus for drilling into a formation proximate the opening while advancing the liner to form the lateral wellbore by leaving at least a portion of the liner in the lateral wellbore.

25. A system for drilling a lateral wellbore in a wellbore, comprising:

a) a liner having at least a portion thereof adapted for leaving in the lateral wellbore;

b) a mill/drill coupled to the liner; and c) a diverter coupled to the mill/drill.

26.The system of claim 25, further comprising a downhole motor coupled to the mill/drill.

27. A method of drilling a lateral wellbore in a wellbore, comprising:

a) inserting a rotary steerable system coupled to a mill/drill into a wellbore having a wall therein;

b) directing the mill/drill towards a pre-selected area of the wall;

c) cutting an opening in the wall with the mill/drill;

d) drilling into a formation proximate the opening while advancing the rotary steerable system to form the lateral wellbore; and e) coupling the rotary steerable system and mill/drill to a liner and leaving at least a portion of the liner in the lateral wellbore after the lateral wellbore is drilled.

28. The method of claim 27, wherein the liner and the mill/drill are rotationally coupled.

29. The method of claim 27, further comprising removing at least a portion of the liner extending into the wellbore from the opening.

30. A system of drilling a lateral wellbore of a well, comprising:

a) an apparatus for inserting a rotary steerable system coupled to a mill/drill into a wellbore having a wall therein;

b) an apparatus for directing the mill/drill towards a pre-selected area of the wall;

c) an apparatus for cutting an opening in the wall with the mill/drill;

d) an apparatus for drilling into a formation proximate the opening while advancing the rotary steerable system to form the lateral wellbore;

e) an apparatus for coupling the rotary steerable system and mill/drill to a liner; and f) an apparatus for leaving at least a portion of the liner in the lateral wellbore after the lateral wellbore is drilled.

31. A method of joining a liner in a lateral wellbore to a casing disposed in a wellbore, comprising:

inserting the liner through an opening in the casing in the wellbore such that a first portion of the liner extends on a first side of the opening, a second portion of the liner extends on a second side of the opening, and a third portion of the liner lies in the opening; and expanding the third portion of the liner into a substantially conformal relationship with the opening without expanding the first or second portion.

* * * * *